US009308540B2

(12) United States Patent
Alcamo

(10) Patent No.: US 9,308,540 B2
(45) Date of Patent: Apr. 12, 2016

(54) SHOWERHEAD ASSEMBLY WITH PRIMARY SHOWERHEAD AND ORBITING SHOWERHEAD

(71) Applicant: FAN FI INTERNATIONAL, INC., Reno, NV (US)

(72) Inventor: Barton J. Alcamo, Reno, NV (US)

(73) Assignee: FAN FI INTERNATIONAL, INC., Reno, NV (US)

( * ) Notice: Subject to any disclaimer, the term of this patent is extended or adjusted under 35 U.S.C. 154(b) by 82 days.

(21) Appl. No.: 13/756,795

(22) Filed: Feb. 1, 2013

(65) Prior Publication Data

US 2013/0200176 A1 Aug. 8, 2013

Related U.S. Application Data

(60) Provisional application No. 61/633,038, filed on Feb. 2, 2012.

(51) Int. Cl.

| | |
|---|---|
| ***B05B 3/08*** | (2006.01) |
| ***B05B 1/14*** | (2006.01) |
| ***B05B 1/16*** | (2006.01) |
| ***B05B 1/18*** | (2006.01) |
| ***B05B 3/02*** | (2006.01) |
| ***B05B 15/06*** | (2006.01) |

(52) U.S. Cl.

CPC ... *B05B 3/08* (2013.01); *B05B 1/14* (2013.01); *B05B 1/1627* (2013.01); *B05B 1/18* (2013.01); *B05B 3/02* (2013.01); *B05B 3/025* (2013.01); *B05B 15/066* (2013.01)

(58) Field of Classification Search

CPC ..... E03C 1/06; B05B 1/30; B05B 3/00; B05B 3/06; B05B 1/16; B05B 1/18; B05B 1/1636; B05B 1/308; F02M 51/00

USPC ..... 239/558, 559, 562, 567, 243, 225.1, 239/237, 240, 246, 247, 264, 265, 239, 239/442–449, 587.1–587.6, 436, 550–551; 4/615, 570, 567

See application file for complete search history.

(56) References Cited

U.S. PATENT DOCUMENTS

| | | | | |
|---|---|---|---|---|
| 2,599,280 | A * | 6/1952 | Phillips | 285/61 |
| 4,752,975 | A * | 6/1988 | Yates | 4/601 |
| 5,884,847 | A | 3/1999 | Christopher | |
| 5,957,387 | A | 9/1999 | Porta et al. | |
| 6,286,158 | B1 * | 9/2001 | Lin | B05B 1/185 239/447 |
| 6,454,186 | B2 * | 9/2002 | Haverstraw et al. | 239/443 |
| 6,775,865 | B1 * | 8/2004 | Lin | 4/615 |
| D508,728 | S | 8/2005 | Kobi et al. | |

(Continued)

*Primary Examiner* — Arthur O Hall
*Assistant Examiner* — Christopher R Dandridge
(74) *Attorney, Agent, or Firm* — Russo & Duckworth, LLP; David Duckworth

(57) ABSTRACT

A showerhead assembly is provided having a primary showerhead which is relatively traditional in construction and includes a hollow housing and a plurality of spray nozzles. In addition, the showerhead assembly includes an orbiting showerhead which rotates about the primary showerhead's central axis. The primary showerhead is connected to a water source by a neck portion having a female threaded inlet. Meanwhile, the orbiting showerhead is rotatably connected to the neck portion by a collar and elbow conduit. Preferably, the orbiting showerhead can tilt inwardly and outwardly with respect to the elbow conduit thereby allowing the spray from the orbiting showerhead to tilt inward or outward relative to the spray from the primary showerhead.

4 Claims, 8 Drawing Sheets

(56) References Cited

U.S. PATENT DOCUMENTS

| | | | | |
|---|---|---|---|---|
| 7,134,614 | B2 | 11/2006 | Miyake et al. | |
| D564,070 | S | 3/2008 | Tsai | |
| 7,380,731 | B1 | 6/2008 | Hsu | |
| 7,611,070 | B2 | 11/2009 | Paoluccio | |
| D621,905 | S | 8/2010 | Yoo et al. | |
| 8,082,610 | B2 * | 12/2011 | Henry | E03C 1/023 239/587.2 |
| 8,177,147 | B2 | 5/2012 | Engel | |
| 2009/0007330 | A1 | 1/2009 | Genord et al. | |

* cited by examiner

SHOWERHEAD ASSEMBLY WITH PRIMARY SHOWERHEAD AND ORBITING SHOWERHEAD

RELATED APPLICATIONS

The present application is a continuation-in-part of co-pending U.S. Provisional Patent Application Ser. No. 61/633,038 filed on Feb. 2, 2012.

BACKGROUND OF THE INVENTION

The present invention relates to showerheads. More particularly, the present invention relates to handheld showerheads producing a plurality of spray patterns and control mechanisms for the control of such spray patterns.

Spray heads are commercially available in numerous designs and configurations for use in showers, faucets, spas, sprinklers and other personal and industrial systems. The vast majority of spray heads may be categorized as being either stationary or oscillating and have either fixed or adjustable openings. Stationary spray heads with fixed jets are the simplest constructions consisting essentially of a central conduit connected to one or more spray jets directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, a pulsating spray, or even a flood pattern providing high fluid flow but decreased velocity. Of course, many other spray patterns may also be provided.

A conventional multifunction showerhead generally requires the user to turn a selector ring or dial on the showerhead faceplate in order to select a desired function. Another approach is to provide a faceplate with several spray jets located in concentric circular patterns. An internal controller, such as controlled by buttons or the like, may be operated to direct the incoming water to any of the various patterns. Examples of such constructions are disclosed in U.S. Pat. Nos. 5,433,384 and 6,622,945.

Unfortunately, these conventional multifunction controllers suffer from various drawbacks. For example, turning a ring or pushing a button adjacent to the showerhead can be difficult to perform by persons having soapy hands. Furthermore, persons tend to look at the showerhead while turning a selector dial or when pushing a button which causes an undesirable spray into a person's face, particularly when a spray pattern changes from a narrow stream to a wide spray.

Handheld showerheads suffer from similar complications. A handheld showerhead typically includes a hollow handle connected to a water supply by a flexible rubber hose. In addition to having the above-described drawbacks of it being difficult to rotate a selector dial or push a button with soapy hands, a person holding the showerhead must utilize both hands, one for holding the handle and the other to control the selector dial or button to change spray patterns.

Even if improved controls were provided, previous showerheads suffer from still additional problems. For example, the human body presents a vertically elongate structure, but a conventional showerhead typically produces a circular spray pattern. Thus, a person receiving water from a showerhead typically will have their face and upper torso sprayed or their lower torso and feet sprayed, but not both.

Thus, it would be desirable to provide a showerhead assembly which provides an elongate spray pattern. Further, it would be desirable to provide a showerhead assembly which provides an elongate spray pattern that can be altered by the person taking a shower.

It would further be advantageous to provide a showerhead assembly that provided a primary spray pattern as well as a secondary spray pattern which could be rotated about the primary spray pattern.

These and other more specific advantages of the invention will be apparent to those skilled in the art from the following detailed description taken in conjunction with the drawings.

SUMMARY OF THE INVENTION

Briefly, in accordance with the invention, an improved showerhead assembly is provided including a primary showerhead and an orbiting showerhead. The primary showerhead can be relatively traditional in construction including a whole housing and a face having one or more spray nozzles for spraying water. The primary showerhead is connected to a water source by a neck portion which preferably includes a female threaded inlet for connecting to a male threaded pipe providing the source of water. The neck portion includes a central conduit for transporting water to the primary showerhead's central cavity for then being ejected from the primary showerhead's spray nozzles.

In addition to the primary showerhead, the showerhead assembly includes an orbiting showerhead which rotates about the primary showerhead's central axis. The orbiting showerhead also includes a housing forming a central conduit for receipt of water, and one or more spray nozzles for spraying water in the same direction as the primary showerhead. The orbiting showerhead is connected to the shower assembly's neck portion by an elbow conduit. Preferably the neck assembly includes one or more holes, or slots, which allows water to flow radially from the shower assembly's neck portion. The elbow conduit is connected to the neck portion by a collar which prevents waters from escaping except from the neck portion's central conduit which transports water to the primary showerhead or to the elbow conduit which transports water to the orbiting showerhead. The collar is rotatable so as to allow the orbiting showerhead to rotate about the showerhead assembly's neck portion while the orbiting showerhead's spray nozzles spray.

In a preferred embodiment, the orbiting showerhead is connected to the elbow conduit by a hinge assembly such as a ball joint for allowing the orbiting showerhead to tilt inwardly or outwardly with respect to the primary showerhead's direction of spray. In still additional preferred embodiments, the orbiting showerhead has a plurality of sets of spray nozzles providing different spray patterns. Moreover, each set of spray nozzles is connected to a discrete flow pathway within the orbiting showerhead's housing. Preferably, the orbiting showerhead includes a controller for selectively causing the diversion of water through the discreet flow pathways so as to turn on or off the flow of water from one or more of the sets of orbital showerhead spray nozzles.

Therefore, it is an object of the present invention to provide a showerhead assembly which provides an elongate spray pattern.

It is still an additional object of the invention to provide a showerhead which provides an elongate spray pattern which can be rotated by the person taking a shower.

It is still an additional object of the present invention to provide a showerhead assembly that provides a primary spray pattern as well as a secondary spray pattern which rotates about the primary spray pattern.

These and other more specific advantages of the invention will be apparent to those skilled in the art from the following description taken in conjunction with the drawings.

DETAILED DESCRIPTION OF THE INVENTION

Figure 1:
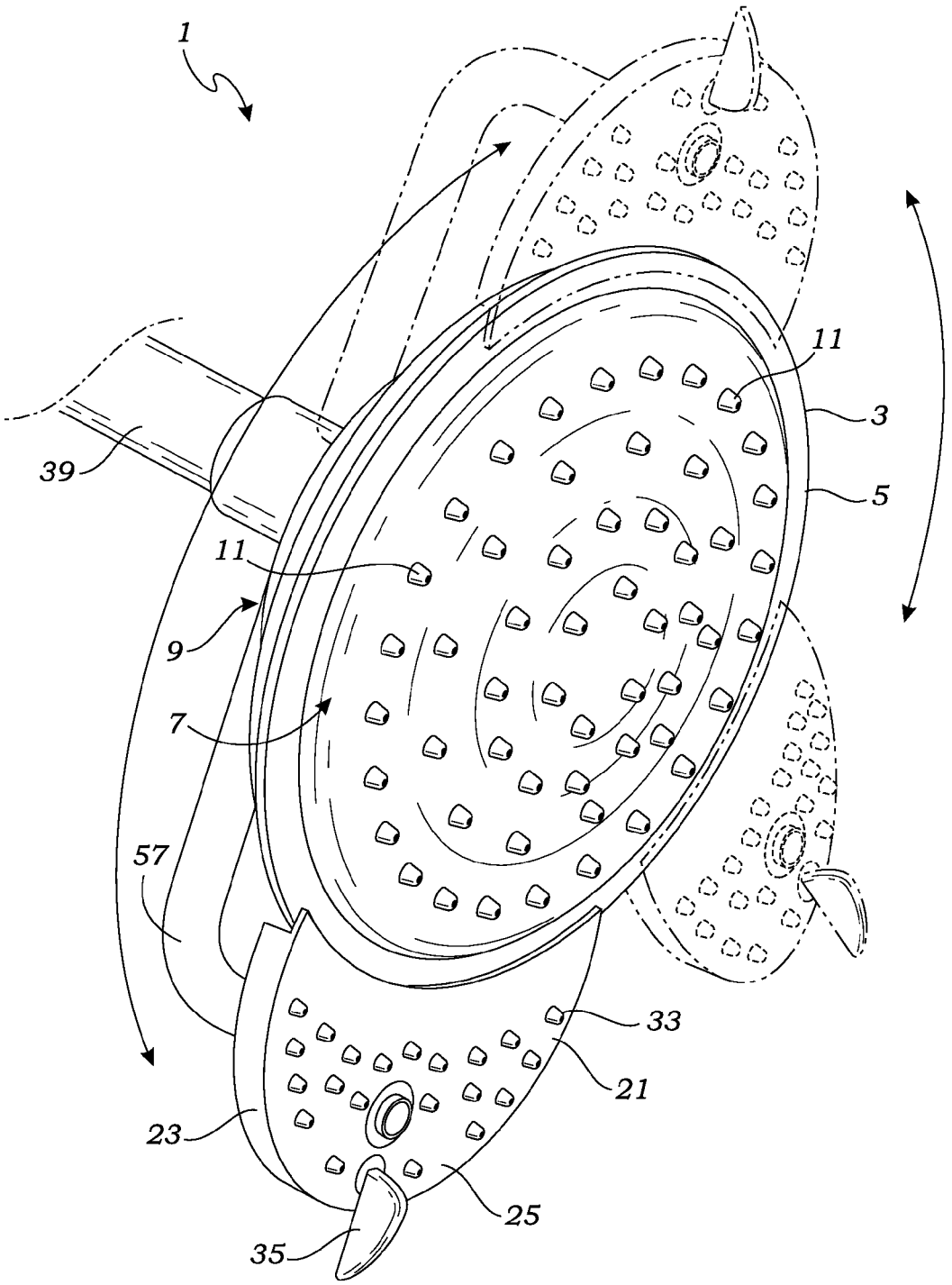
FIG. 1 is a perspective view of the showerhead assembly of the present invention.

While the present invention is susceptible of embodiment in various forms, as shown in the drawings, hereinafter will be described the presently preferred embodiments of the invention with the understanding that the present disclosure is to be considered as an exemplification of the invention, and the present disclosure is not intended to limit the invention to specific embodiments illustrated.

Two preferred embodiments of the showerhead assembly 1 of the present invention are illustrated in FIGS. 1-18. As illustrated in the figures, the showerhead assembly 1 includes both a primary showerhead 3 and an orbiting showerhead 21. The primary showerhead 3 may incorporate various constructions known to those skilled in the art. For example, as illustrated in the figures, the primary showerhead may have a relatively simple and traditional showerhead design including a plurality of nozzles for providing a simple spray pattern. However, the primary showerhead may incorporate more complex constructions for providing selectable and controllable spray patterns such as illustrated in U.S. Pat. No. 8,177,147 issued on May 15, 2012 which is incorporated in its entirety herein. As illustrated in FIGS. 1-4 and 11-14, the simple primary showerhead 3 includes a showerhead housing 5. The housing 5 has a front 7 and a back 9. Projecting from the front of the showerhead are nozzles 11 for ejecting water.

As illustrated in FIGS. 2-4 and 12-14, the showerhead assembly 1 includes a neck portion 41 for connecting the showerhead assembly to a water source such as a threaded male pipe 39. To connect the showerhead assembly 1 to a male threaded pipe, the neck portion includes a female threaded inlet 45 and a central conduit 43 for allowing water to pass through into the cavity within the primary showerhead housing 5.

In addition to a relatively traditional primary showerhead 3 and a neck portion 41, the showerhead assembly 1 of the present invention includes an orbiting showerhead 21. As best illustrated in FIGS. 1-4, 11-14 and 18, the orbiting showerhead 21 is a secondary showerhead which rotates, in other words "orbits" around the primary showerhead 3. Like the primary showerhead, the orbiting showerhead 21 has a housing 23 including a front 25 and a back 29. Projecting from the orbiting showerhead's front are nozzles 33. Again, the orbiting showerhead is illustrated as having a simple construction wherein water enters the housing and simply exits the nozzles 33. However, the orbiting showerhead may also incorporate various mechanisms for selectively controlling the flow of water to provide selectable spray patterns or for increasing or decreasing the flow of water from one or more of the orbiting showerhead's nozzles. As an example, in a preferred embodiment illustrated in FIGS. 11 and 15, it is preferred that the orbiting showerhead 21 include a single large central jet nozzle 37 and a plurality of smaller spray nozzles 33. Preferably, the jet nozzle 37 and spray nozzles are connected to discrete flow pathways, respectively. Also preferably, the orbiting showerhead includes a controller for selectively causing the diversion of water through the discrete flow pathways so as to turn on or off the flow of water from one or more of the sets of orbital showerhead spray nozzles. As illustrated in FIGS. 11-15, preferably tab 35 can be rotated relative to the orbiting showerhead's housing to alter the flow of water through the discrete pathways. For example, rotation of the tab 35 to different positions preferably causes water: to be obstructed from both the jet nozzle 37 and spray nozzles 33; to spray from both the jet nozzle 37 and spray nozzles 33; to spray from only jet nozzle 37; or to spray only from spray nozzles 33. Mechanisms for controlling the flow of water and/or spray patterns can be selected by those skilled in the art without undue experimentation.

Figure 11:
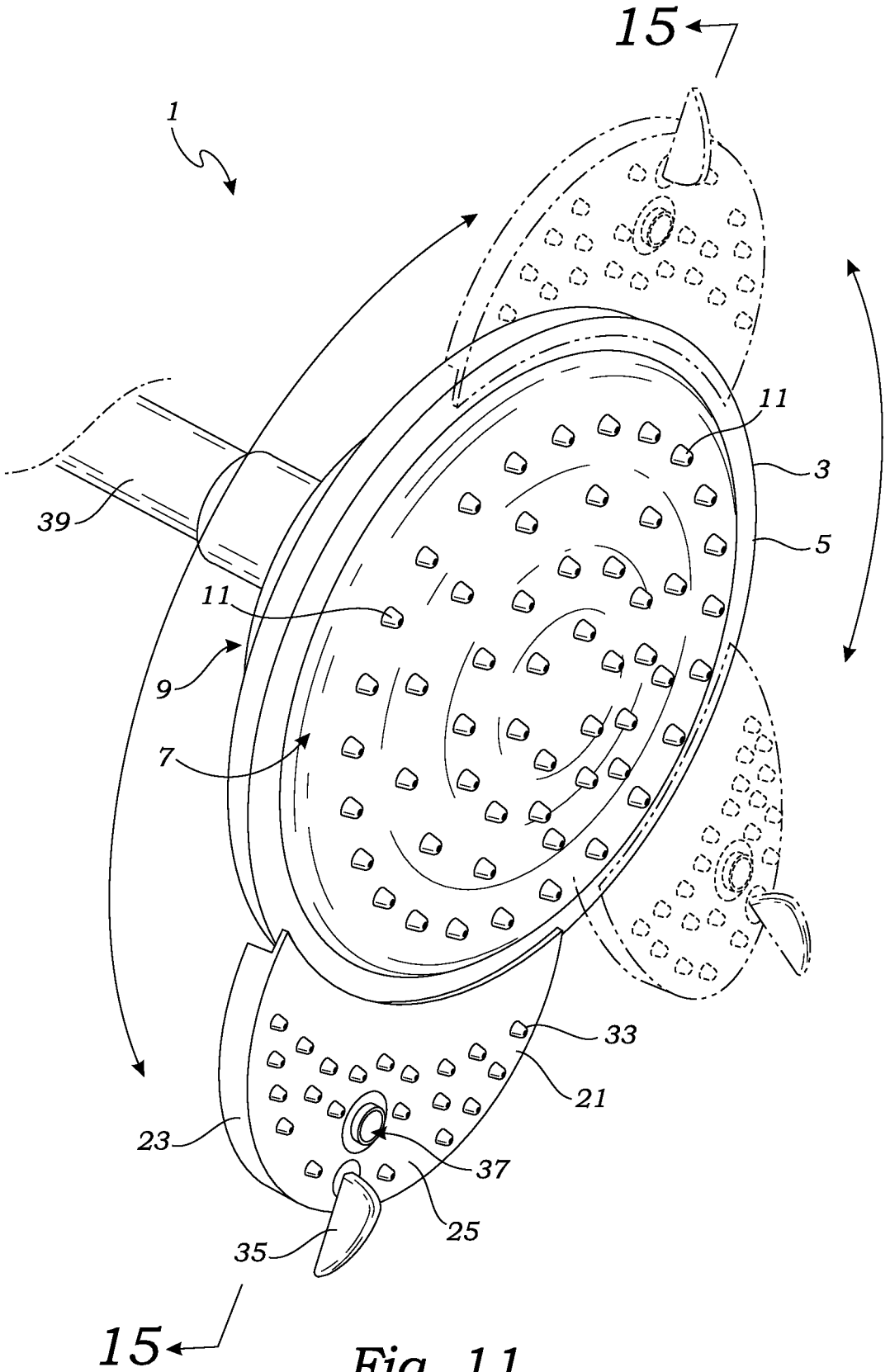
FIG. 11 is a perspective view of a second embodiment of the showerhead assembly of the present invention.
Figure 14:
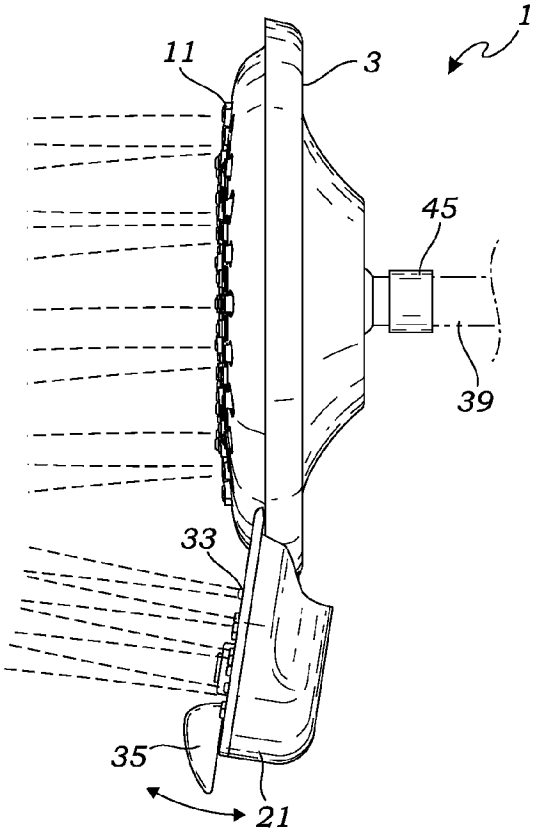
FIG. 14 is a side view of the second embodiment of the showerhead assembly of the present invention wherein the orbiting showerhead sprays inwardly.
Figure 13:
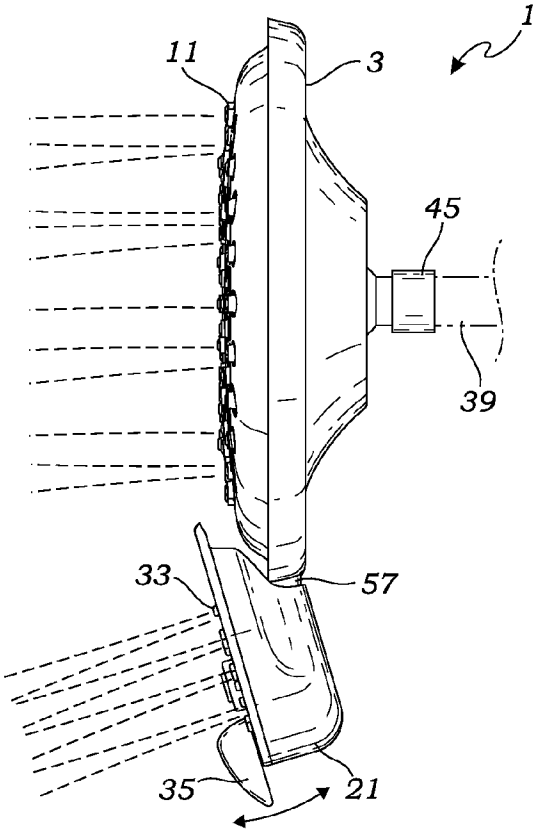
FIG. 13 is a side view of the second embodiment of the showerhead assembly of the present invention wherein the orbiting showerhead sprays outwardly.
Figure 12:
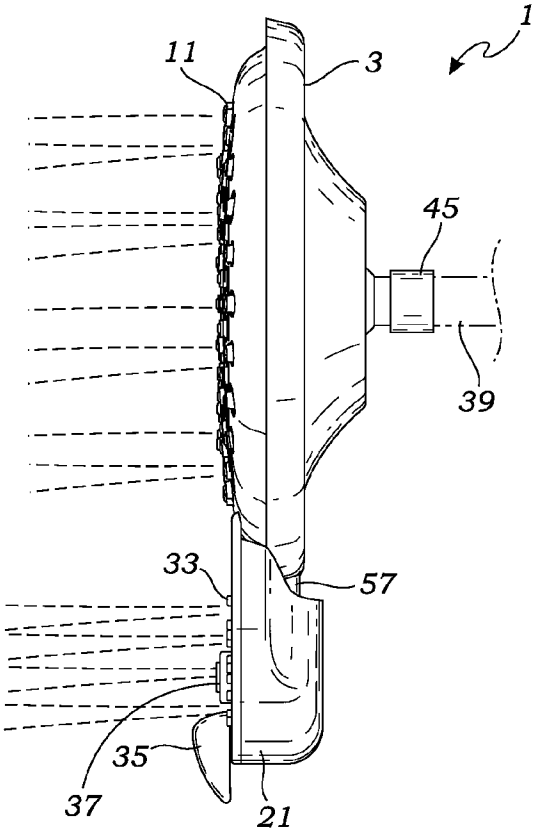
FIG. 12 is a side view of the second embodiment of the showerhead assembly of the present invention wherein the orbiting showerhead sprays directly forward.
Figure 15:
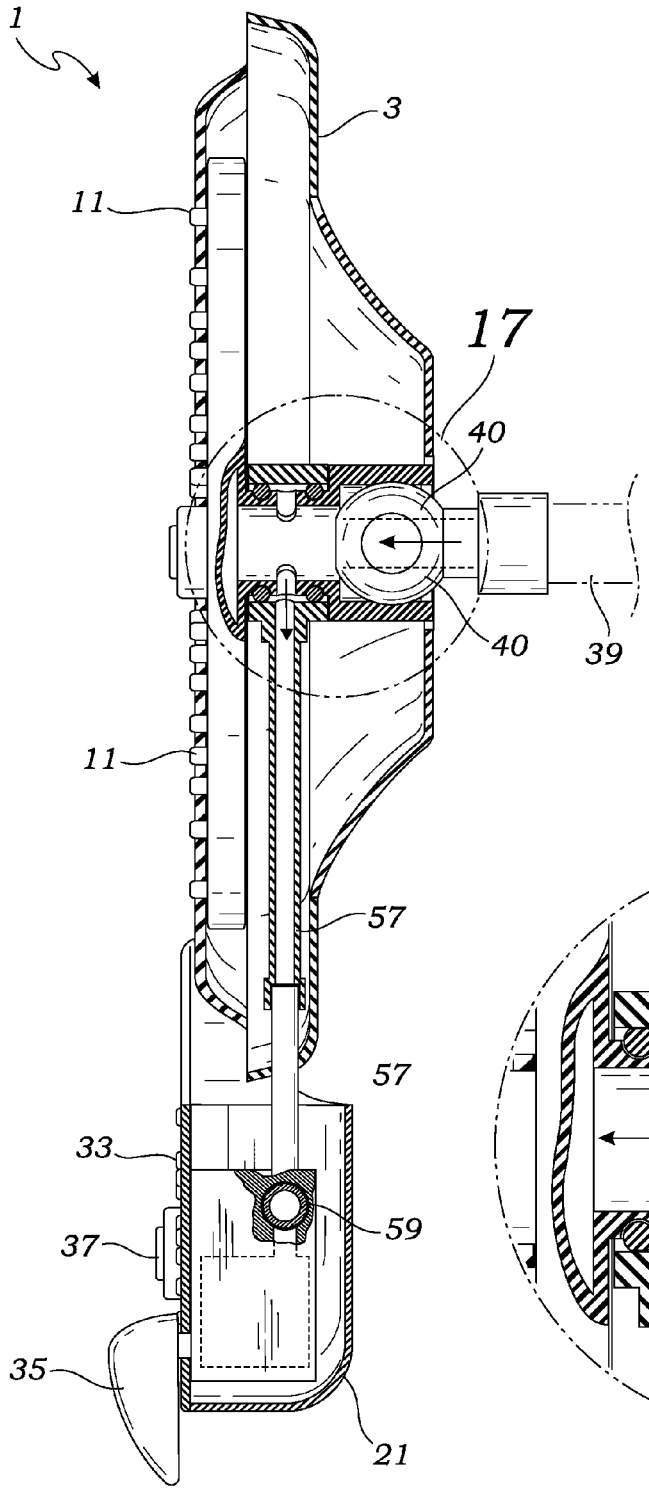
FIG. 15 is a cut-away view of the second embodiment of the showerhead assembly's neck portion.
Figure 16:
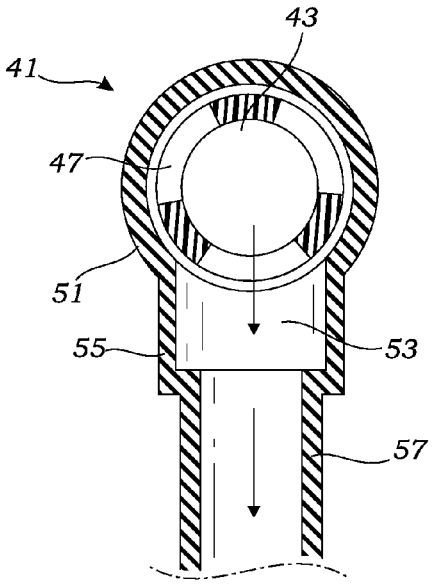
FIG. 16 is a cut-away view of the second embodiment of the showerhead assembly's neck portion illustrating the elbow conduit's ability to rotate.
Figure 17:
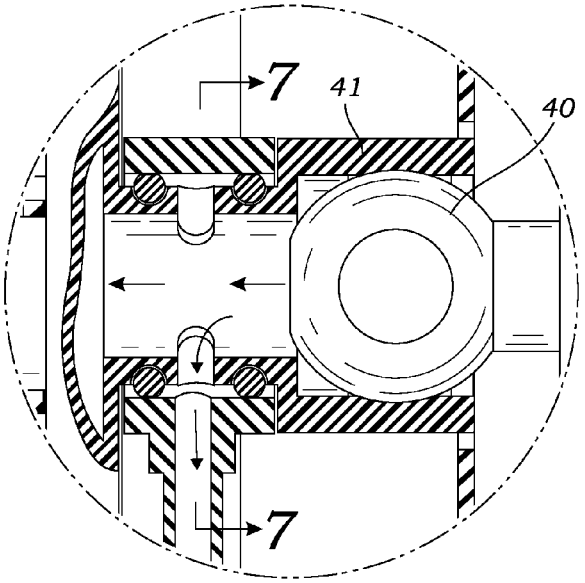
FIG. 17 is a cut-away view of the second embodiment of the showerhead assembly's neck portion illustrating the flow of water.
Figure 18:
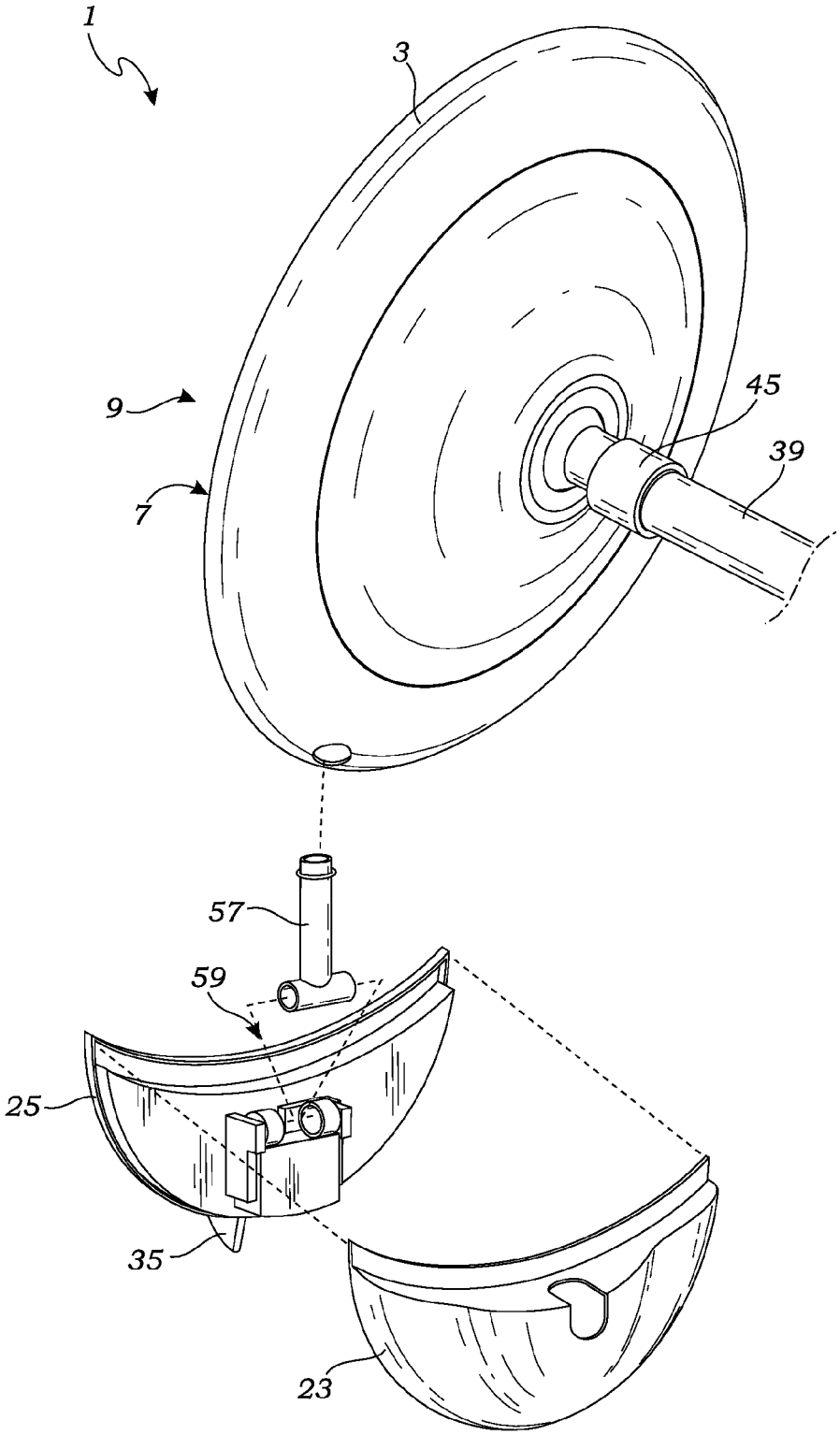
FIG. 18 is an exploded rear perspective view of the second embodiment of the showerhead assembly of the present invention illustrating the connection of the orbiting showerhead to the primary showerhead.

As illustrated in FIGS. 1 and 11, the orbiting showerhead 21 is capable of rotating about the longitudinal axis of the primary showerhead 3. As illustrated in FIGS. 5-7 and 15-17, water is directed from the neck portion 41 to the orbiting showerhead 21 through an elbow conduit 57. The elbow conduit may be constructed in one piece and may be positioned outside the primary showerhead's housing as illustrated in FIGS. 1-4. Alternatively, the elbow conduit may be constructed in multiple pieces, such as a two piece construction, and may be positioned outside the primary showerhead's housing as illustrated in FIG. 15.

The elbow conduit 57 connects to the neck portion by a rotatable coupling 51. In addition, the rotatable coupling has an opening 53 which connects to the elbow conduit 57 by a collar 55. As illustrated in FIGS. 5-7 and 15-17, the neck portion's central conduit 43 includes one or more holes 47, which as illustrated, are preferably slots for allowing water to project laterally from the conduit 43 through the rotatable coupling's opening 53 into the elbow conduit 57. Though three slots are illustrated, the conduit may include more or less slots 47 for allowing the passage of water through the elbow conduit 57 to the orbiting showerhead 21. Preferably, the neck portion 41 includes two or more "O" rings 49 to prevent water from leaking from the showerhead's neck portion.

Figure 4:
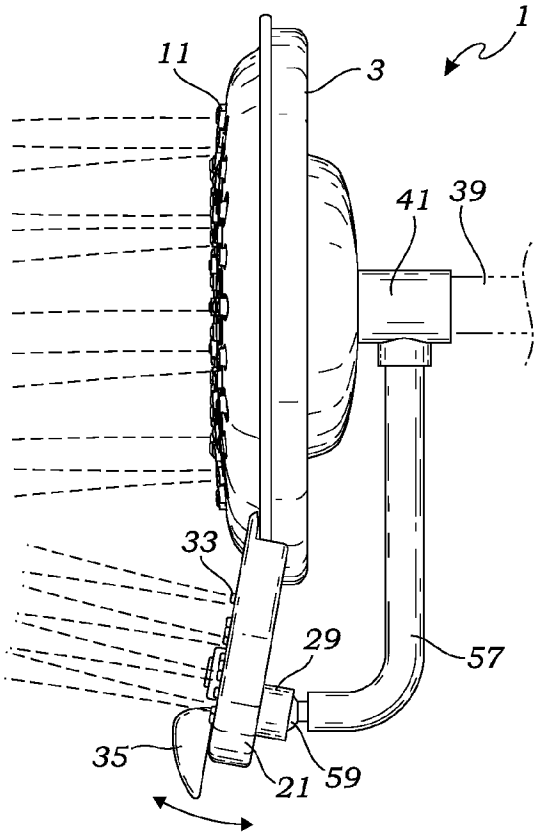
FIG. 4 is a side view of the showerhead assembly of the present invention wherein the orbiting showerhead sprays inwardly.
Figure 3:
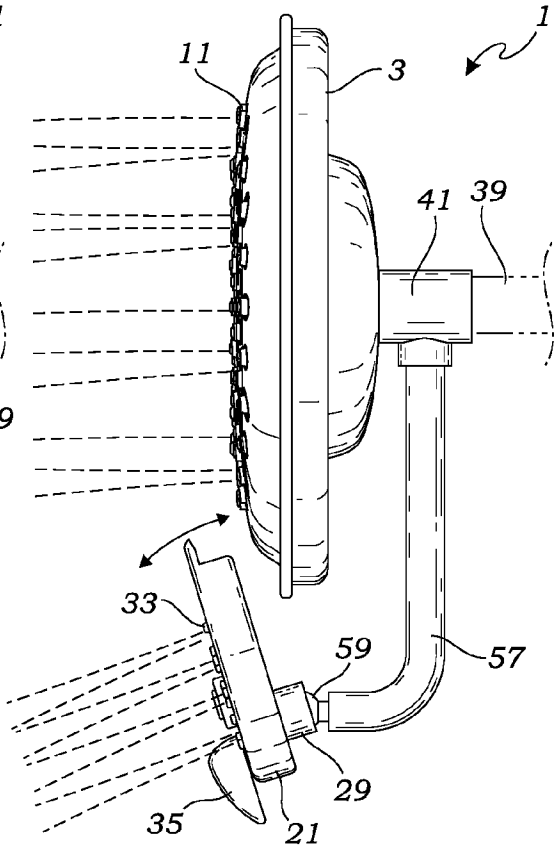
FIG. 3 is a side view of the showerhead assembly of the present invention wherein the orbiting showerhead sprays outwardly.
Figure 2:
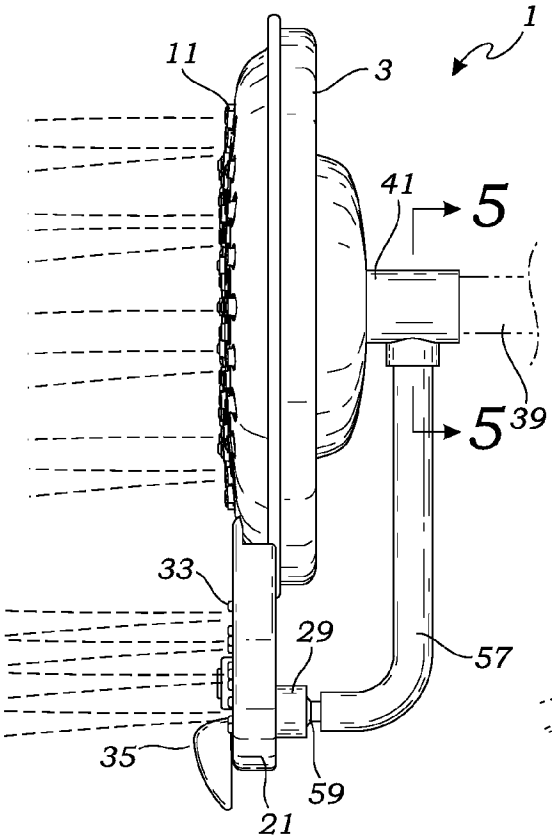
FIG. 2 is a side view of the showerhead assembly of the present invention wherein the orbiting showerhead sprays directly forward.
Figure 5:
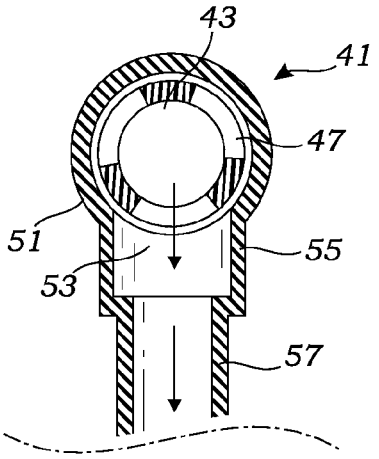
FIG. 5 is a cut-away view of the showerhead assembly's neck portion.
Figure 6:
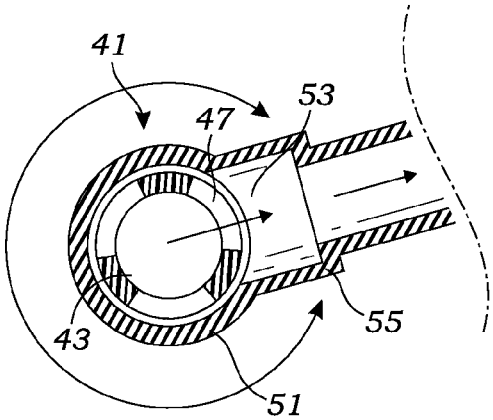
FIG. 6 is a cut-away view of the showerhead assembly's neck portion illustrating the elbow conduit's ability to rotate.
Figure 7:
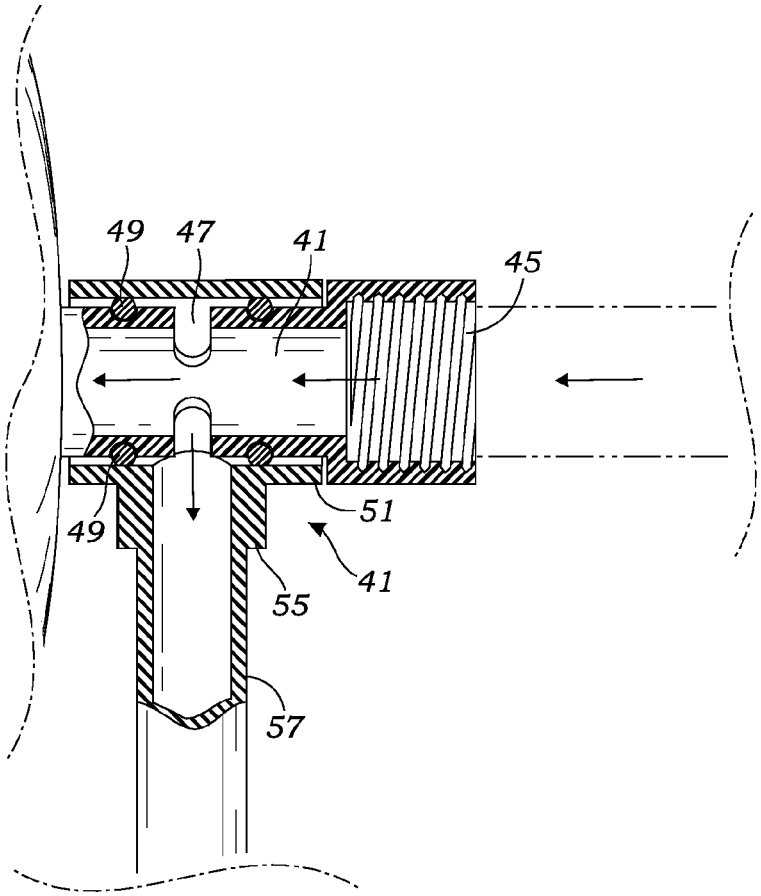
FIG. 7 is a cut-away view of the showerhead assembly's neck portion illustrating the flow of water.
Figure 8:
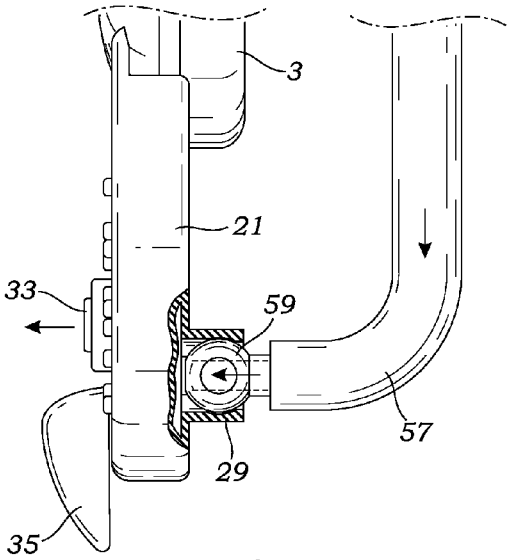
FIG. 8 is a side view of the showerhead assembly including a cut-away view illustrating the manner the orbiting showerhead can tilt.
Figure 9:
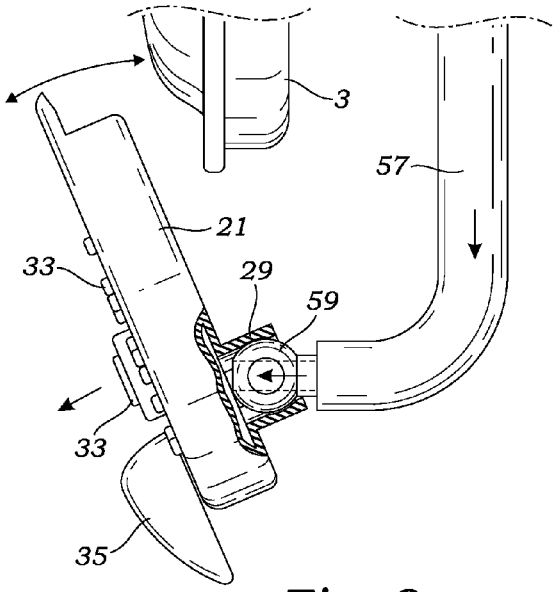
FIG. 9 is an additional side view of the showerhead assembly including a cut-away view illustrating the orbiting showerhead ability to tilt outwardly.
Figure 10:
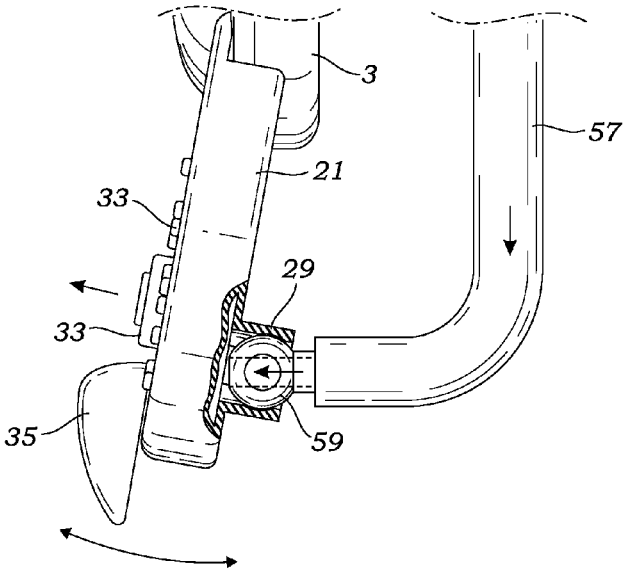
FIG. 10 is an additional side view of the showerhead assembly including a cut-away view illustrating the orbiting showerhead ability to tilt inwardly.

In addition to rotating about the primary showerhead 3, the orbiting showerhead is capable of tilting inwardly and outwardly. As illustrated in FIGS. 2-4 and 8-10, the orbiting showerhead has an inlet 29 formed with a spherical cavity 31. Meanwhile, the elbow conduit 57 has a hinge 59 to allow the orbiting showerhead to tilt inwardly and outwardly with respect to the elbow conduit 57, thereby allowing the spray from the orbiting showerhead to tilt inward or outward relative to the spray from the primary showerhead. As illustrated in FIGS. 2-4, the hinge 59 is constructed as a ball joint sized for projecting into the orbiting showerhead's inlet's spherical cavity to allow the orbiting showerhead to tilt inwardly and outwardly with respect to the elbow conduit 57. In an alternative embodiment illustrated in FIGS. 15 and 18, the hinge 59 is constructed as a "T" shaped conduit wherein two opposing ends of the "T" conduit are rotatably received within a pair of inlet ports. The inlet ports are connected to the discrete pathways, which in turn, convey water to the jet nozzle 37 and spray nozzles 33.

Advantageously, the present invention provides an improved showerhead assembly. While a preferred showerhead assembly has been illustrated and described, it will be apparent that various modifications can be made without departing from the spirit and scope of the invention. For example, the showerhead assembly is illustrated with the orbiting showerhead connected to the showerhead assembly's neck portion through an elbow conduit. However, other connections may be utilized to transfer water from the water source to the orbiting showerhead.

While several particular forms of the invention have been illustrated and described, it will be apparent that various modifications can be made without departing from the spirit and scope of the invention. Accordingly, it is not intended that the invention be limited except by the following claims. Having described my invention in such terms so as to enable a person skilled in the art to understand the invention, recreate the invention, and practice it, and having presently identified the presently preferred embodiments thereof.

I claim:

1. A showerhead assembly comprising:

a male threaded pipe of a water supply;

a hollow neck portion having a female threaded inlet threadably affixed to said male threaded pipe to receive water into said neck portion, said hollow neck portion including a cylindrical sidewall and longitudinally extending central conduit for the passage of water received from said male threaded pipe, said hollow neck portion further including a plurality of holes which extend through said neck portion cylindrical sidewall;

a primary showerhead non-rotatably connected to said hollow neck portion for receiving water from said neck portion, said primary showerhead having nozzles for spraying a liquid in a first direction defining a first axis;

a hollow coupling having coupling sidewall and a cylindrical center bore which concentrically receives and rotates about said hollow neck portion's cylindrical sidewall, said coupling sidewall having an opening which, upon the rotation of said coupling, is in fluid communication with said one or more neck portion holes for receiving water from said neck portion holes;

an elbow conduit having a first end and a second end, said elbow conduit's first end engaging and connected to said coupling sidewall's opening, said elbow conduit's first end connected to said coupling sidewall's opening so that a liquid in said neck portion flows through said one or more holes, through said coupling opening and into said elbow conduit, said elbow conduit is rotatable about said neck portion with the rotation of said coupling so that said elbow conduit is capable of rotating about said first axis while said hollow neck portion and said primary showerhead are not rotated about said first axis; and an orbiting showerhead connected to said elbow conduit's second end so as to rotate concentrically about said primary showerhead's first axis while said primary showerhead and hollow neck portion remain rotationally stationary, said orbiting showerhead having orbiting spray nozzles positioned to spray water in the same direction as said primary showerhead nozzles.

2. The showerhead assembly of claim 1 wherein said orbiting showerhead is hingedly connected to said elbow conduit to permit said orbiting showerhead to tilt inward or outward relative to said primary showerhead's first axis.

3. The showerhead assembly of claim 1 wherein said orbiting showerhead further comprises:

a plurality of sets of spray nozzles and said orbiting showerhead having a plurality of discrete flow pathways for directing water from said elbow conduit to said plurality of sets of spray nozzles; and a controller for selectively causing the diversion of water to flow, or not to flow, through said discrete flow pathways so as to cause water to selectively spray, or not spray, from said of sets of orbiting spray nozzles.

4. A showerhead assembly comprising:

a male threaded pipe of a water supply;

a hollow neck portion having a female threaded inlet threadably affixed to said male threaded pipe to receive water into said neck portion, said hollow neck portion including a cylindrical sidewall and longitudinally extending central conduit for the passage of water received from said male threaded pipe, said hollow neck portion further including a plurality of holes which extend through said neck portion cylindrical sidewall;

a primary showerhead non-rotatably connected to said hollow neck portion for receiving water from said neck portion, said primary showerhead having nozzles for spraying a liquid in a first direction defining a first axis;

a hollow coupling having a cylindrical center bore forming a coupling sidewall wherein said center bore concentrically receives and rotates about said hollow neck portion's cylindrical sidewall, said coupling sidewall having an opening which, upon the rotation of said coupling, is in fluid communication with said one or more neck portion holes for receiving water from said neck portion holes;

an elbow conduit having a first end and a second end, said elbow conduit's first end engaging and connected to said coupling sidewall's opening, said elbow conduit's first end connected to said coupling sidewall's opening so that a liquid in said neck portion flows through said one or more holes, through said coupling opening and into said elbow conduit, said elbow conduit is rotatable about said neck portion with the rotation of said coupling so that said elbow conduit is capable of rotating about said first axis while said hollow neck portion and said primary showerhead are not rotated about said first axis; and an orbiting showerhead connected to said elbow conduit's second end so as to rotate concentrically about said primary showerhead's first axis while said primary showerhead and hollow neck portion remain rotationally stationary, said orbiting showerhead having orbiting spray nozzles positioned to spray water in the same direction as said primary showerhead nozzles and said orbiting showerhead being hingedly connected to said elbow conduit to permit said orbiting showerhead to tilt inward or outward relative to said primary showerhead's first axis.

* * * * *